United States Patent [19]

Petro et al.

[11] 4,167,361

[45] Sep. 11, 1979

[54] TEMPORARY MINE ROOF PROP

[75] Inventors: Michael Petro, Coraopolis; Joseph R. Betz, Zelienople; Duane W. DeArmitt, Butler, all of Pa.

[73] Assignee: Mine Safety Appliances Company, Pittsburgh, Pa.

[21] Appl. No.: 938,069

[22] Filed: Aug. 30, 1978

[51] Int. Cl.[2] ..... E21D 15/44

[52] U.S. Cl. ..... 405/290; 248/356; 405/289

[58] Field of Search ..... 405/290, 291, 289, 288; 248/2, 356; 299/11, 31–33; 91/170 MP

[56] References Cited

U.S. PATENT DOCUMENTS

| | | | |
|---|---|---|---|
| 1,752,101 | 3/1930 | Meutsch | 405/290 X |
| 2,695,764 | 11/1954 | Grebe | 248/356 |
| 2,752,757 | 7/1956 | Joy | 248/356 X |
| 2,753,036 | 7/1956 | Joy | 248/356 X |
| 2,888,231 | 5/1959 | Duncan | 248/356 |

FOREIGN PATENT DOCUMENTS

| | | | |
|---|---|---|---|
| 747266 | 5/1956 | United Kingdom | 248/356 |
| 116776 | 1/1959 | U.S.S.R. | 405/290 |

*Primary Examiner*—Dennis L. Taylor

*Attorney, Agent, or Firm*—Brown, Flick & Peckham

[57] ABSTRACT

The base member of a mine roof prop is provided with a closed lower chamber and an adjoining open-top upper chamber in which the lower end of a post is slidably mounted, with means at the upper end of the post for engaging a mine roof. A body of liquid is supported in the lower chamber by flexible means, below which there is an air inlet. The base member also has a liquid passage connecting the upper part of the lower chamber with the lower part of the upper chamber so that when compressed air is delivered to the air inlet, the flexible means will force liquid up through the passage and into the upper chamber to raise the post, whereupon a valve can be closed to trap the liquid in the upper chamber.

8 Claims, 4 Drawing Figures

TEMPORARY MINE ROOF PROP

It is among the objects of this invention to provide a mine roof prop which is suitable for temporary use, which can be erected and removed with a minimum of time and manpower, which is operated by air pressure, and which provides safe support for variable roof conditions.

The preferred embodiment of the invention is illustrated in the accompanying drawings, in which FIG. 1 is a vertical section of the collapsed prop;

Figure 1:
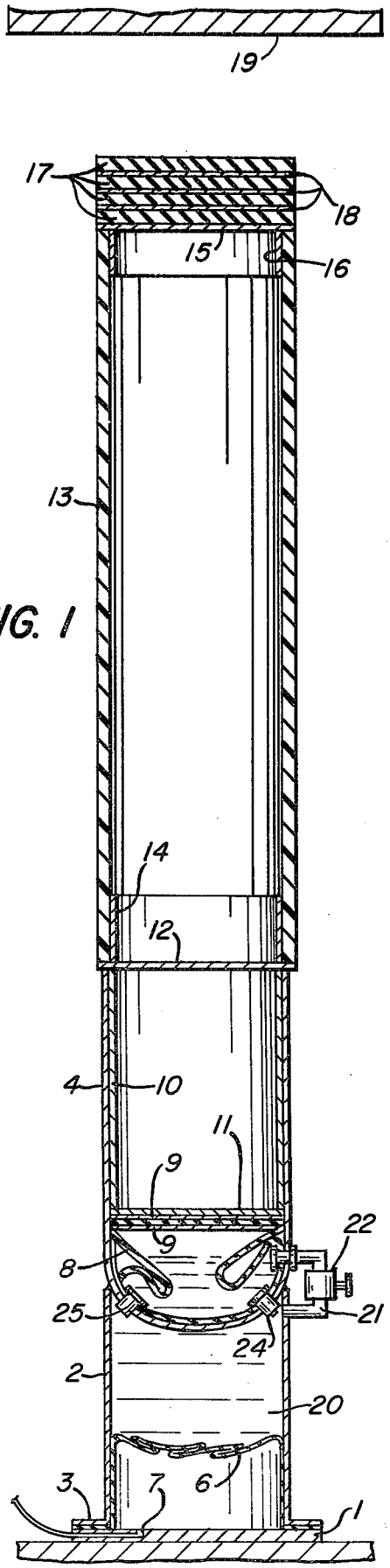

Referring to FIG. 1 of the drawings, a base plate 1 supports a lower cylindrical shell 2 having an encircling flange 3 at its lower end. Seated on the upper end of the shell and welded to it is the lower end of an upper cylindrical shell 4 that has a closed spherical bottom. The two shells and the base plate together form a base member provided with upper and lower chambers. Inside the lower chamber there is a flexible member, which may be a bladder 6 having a lower end clamped between flange 3 and the base plate. The latter is provided with an inlet passage 7 for air under pressure from any suitable source.

Disposed in the lower part of the upper chamber 4 is another bladder 8, the upper part of which is sandwiched between two flat metal plates 9 that are secured to it, such as by a suitable adhesive. Resting on the upper plate is the lower end of a hollow post. The lower portion of the post is formed from a metal tube 10 closed at its lower end by a metal plate 11. The tube is slidably disposed in the base member and extends above it and supports a metal plate 12 extending radially outwardly around the tube, to which it is welded. Resting on the marginal portion of this plate 12 is the lower end of a much longer tube 13, which preferably is formed of material having a high strength to weight ratio, such as fiberglass, to reduce its weight. This tube is centered on plate 12 by means of a short sleeve 14 welded to the plate and extending up into the tube. Seated on the upper end of tube 13 is a metal plate 15 that is held in place by a sleeve 16 extending into the tube. This plate supports a stack of elastomeric pads 17 separated by thin metal plates 18 and all secured together. The upper pad is designed for engagement with a mine roof 19.

Figure 2:
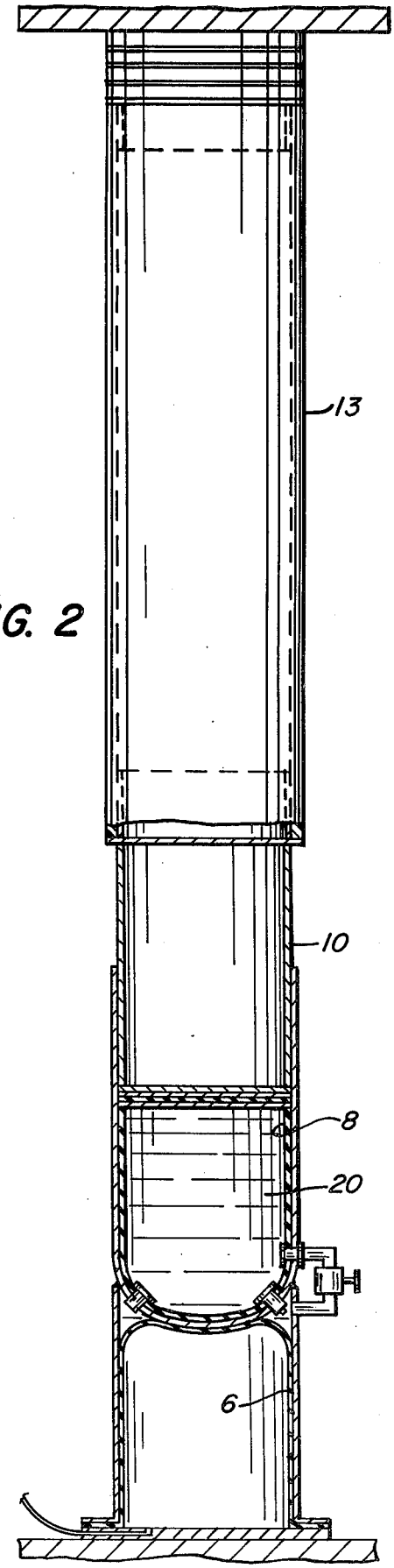
FIG. 2 is a similar view of the prop while extended.

While the lower bladder is collapsed in the lower chamber, the space above the bladder contains hydraulic fluid, such as oil or water 20. The upper part of the lower chamber is connected by a conduit 21 to the inside of the upper bladder near its lower end. The conduit is provided with a shutoff valve 22. When a compressed air line is connected to the outer end of inlet passage 7, the lower bladder will be expanded upwardly and will force the liquid up through conduit 21 and the open valve and into the upper bladder, which the liquid will cause to expand. As this bladder expands, it forces the post upwardly against the mine roof. When the prop exerts the desired pressure, valve 22 is closed in order to trap the liquid in the upper bladder as shown in FIG. 2.

Figure 3:
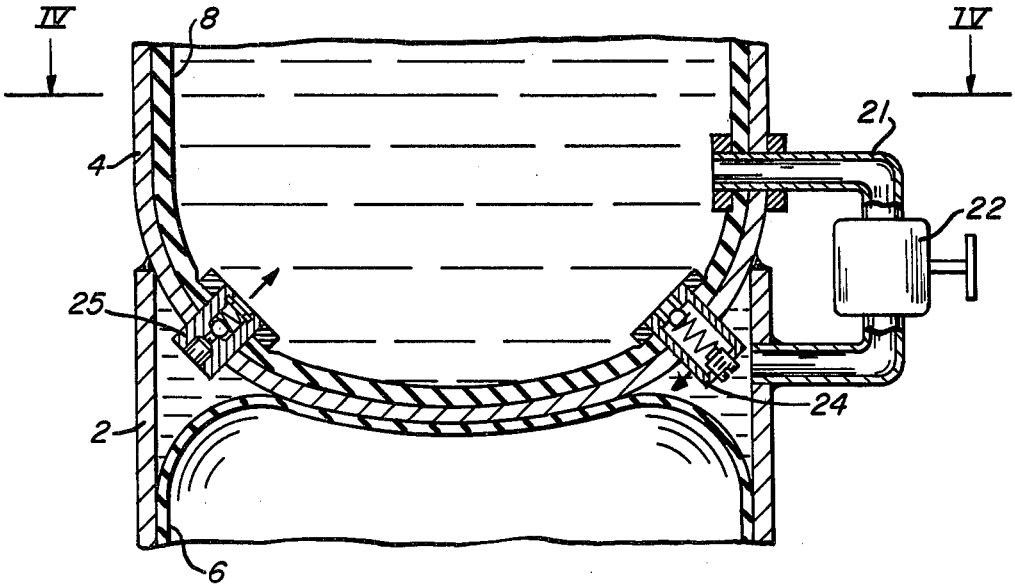
FIG. 3 is an enlarged fragmentary vertical section of the valved area of the prop.
Figure 4:
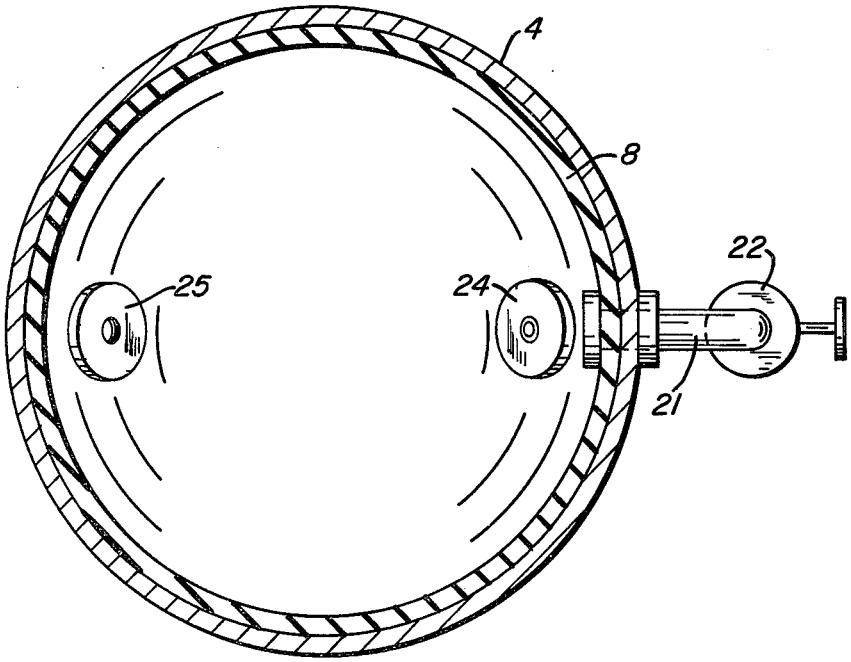
FIG. 4 is a horizontal section taken on the line IV—IV of FIG. 3.

If the prop comes under increased load, due to settling of the roof, the downward pressure on the liquid in the upper bladder will be increased. To prevent overloading of the prop, it is allowed to yield, resulting in redistribution of the roof load. This is accomplished by providing an adjustable relief valve 24 (FIG. 3) that extends from inside the bottom of the upper bladder down into the upper part of the lower chamber. When a predetermined pressure is reached in the upper bladder, this valve allows liquid to be forced from the upper bladder down into the lower chamber, thereby shortening the prop, which reduces the total load on it.

In addition to conduit 21, an upwardly opening check valve 25 (FIG. 3) can be mounted in the bottom of the upper chamber for connecting the upper part of the lower chamber with the inside of the upper bladder. When such a check valve is used, the shutoff valve 22 can remain closed during extension of the prop and be opened only when it is desired to release the liquid from the upper bladder in order to lower the upper end of the post so that the prop can be removed. The valve can be arranged in such a way, if desired, that can be opened from a remote location by pulling on a line attached to it.

The stack of resilient pads at the top of the post performs two functions. First, it helps to provide a uniform distribution of the load on the installed prop. Second, it will allow some lateral movement of the roof to occur with a reduced lateral strain on the prop.

By forming the post from tubular sections detachably connected together and also easily removable from the base member, the prop can be disassembled and easily carried from one location to another.

The use of bladders makes it unnecessary to employ annular seals to prevent leakage past pistons.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A mine roof prop comprising a base member provided with a closed lower chamber and an adjoining open-top upper chamber, a post slidably mounted in the upper chamber and extending above the base member, means at the upper end of the post for engaging a mine roof, flexible means in the lower chamber supporting a body of liquid, said base member having an air inlet below said flexible means and having a liquid passage connecting the upper part of the lower chamber with the lower part of the upper chamber, and a valve for closing said passage, whereby when compressed air is delivered to said air inlet said flexible means will be moved upwardly to force said liquid through said liquid passage and opened valve into the upper chamber to raise said post, whereupon closing of the valve will trap the liquid in the upper chamber.

2. A mine roof prop according to claim 1, in which said valve is an upwardly opening check valve, and said base member is provided with a second passage connecting the lower part of the upper chamber with the upper part of the lower chamber, and a normally closed valve for said second passage adapted to be opened to allow liquid to flow down through that passage to permit said post to descend.

3. A mine roof prop according to claim 1, including a relief valve connecting the lower part of said upper chamber with the lower chamber above said flexible means.

4. A mine roof prop according to claim 1, including a normally collapsed bladder mounted in said upper chamber, the upper end of said liquid passage opening into the bladder for expanding it to raise said post.

5. A mine roof prop according to claim 4, in which said flexible means is a normally collapsed bladder below said liquid passage secured to the lower part of said lower chamber, said air inlet opening into the last-mentioned bladder for expanding it to force said liquid into the upper chamber.

6. A mine roof prop according to claim 5, in which said valve is an upwardly opening check valve, and said base member is provided with a second passage connecting the inside of said first-mentioned bladder with the upper part of the lower chamber, and a normally closed valve for said second passage.

7. A mine roof prop according to claim 1, in which said flexible means is a normally collapsed bladder below said liquid passage secured to the lower part of said lower chamber, said air inlet opening into the bladder for expanding it to force said liquid into the upper chamber.

8. A mine roof prop according to claim 1, in which said roof-engaging means at the upper end of the post includes a elastomeric pad.

* * * * *